US007147934B2

(12) United States Patent
Yamamoto et al.

(10) Patent No.: US 7,147,934 B2
(45) Date of Patent: Dec. 12, 2006

(54) CHEMICALLY PROCESSED STEEL SHEET EXCELLENT IN CORROSION RESISTANCE

(75) Inventors: Masaya Yamamoto, Sakai (JP); Mitsuo Asabuki, Sakai (JP); Shigeyasu Morikawa, Sakai (JP); Shinya Furukawa, Sakai (JP); Hirofumi Taketsu, Sakai (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 10/829,678

(22) Filed: Apr. 22, 2004

(65) Prior Publication Data

US 2005/0003226 A1 Jan. 6, 2005

Related U.S. Application Data

(63) Continuation-in-part of application No. 09/992,962, filed on Nov. 6, 2001, now Pat. No. 6,730,414.

(30) Foreign Application Priority Data

Jul. 11, 2000 (JP) ..... 2000-338513
Jul. 11, 2000 (JP) ..... 2000-338515

(51) Int. Cl.
*B32B 15/04* (2006.01)
*B32B 15/18* (2006.01)
*B32B 15/20* (2006.01)

(52) U.S. Cl. ..... 428/653; 428/651; 428/681; 428/633; 428/450; 428/702

(58) Field of Classification Search ..... 428/650, 428/653, 654, 681, 684, 685, 641, 651, 652, 428/632, 702
See application file for complete search history.

(56) References Cited

U.S. PATENT DOCUMENTS 5,789,089 A 8/1998 Maki et al.
6,361,833 B1 3/2002 Nakada et al.
6,361,881 B1 3/2002 Izaki et al.
6,509,099 B1 * 1/2003 Urata et al. ..... 428/423.1
2002/0098345 A1 * 7/2002 Kamo et al. ..... 428/336
2002/0114971 A1 * 8/2002 Yamamoto et al. ..... 428/632

FOREIGN PATENT DOCUMENTS

| | | | |
|---|---|---|---|
| JP | 09-020984 | | 1/1997 |
| JP | 3302677 | | 4/2002 |
| JP | 2002-146551 | * | 5/2002 |
| JP | 2002-146553 | * | 5/2002 |
| JP | 2003-213458 | * | 7/2003 |
| JP | 2004-052000 | * | 2/2004 |
| WO | WO 00/24948 | | 5/2000 |

* cited by examiner

*Primary Examiner*—Michael E. Lavilla
(74) *Attorney, Agent, or Firm*—The Webb Law Firm

(57) ABSTRACT

A chemically processed steel sheet comprises a steel base coated with an Al—Si alloy plating layer, whose Si content is preferably adjusted to 5–13 mass % as a whole and to 7–80 mass % at a surface, and a converted layer generated on the surface of the plating layer. The converted layer contains both soluble and scarcely-soluble compounds. The soluble compound, such as a manganese oxide or hydroxide, or a valve metal fluoride, is once dissolved into water in an atmosphere and then re-precipitated as scarcely-soluble compounds at defective parts of the converted layer. The scarcely-soluble compounds act as a barrier for corrosion prevention of a base steel. Due to the re-precipitation, i.e., self-repairing faculty, excellent corrosion resistance of the converted layer is still maintained even after defects are introduced therein during plastic deformation of the steel sheet.

6 Claims, No Drawings

CHEMICALLY PROCESSED STEEL SHEET EXCELLENT IN CORROSION RESISTANCE

CROSS REFERENCE TO RELATED APPLICATIONS

This application is a continuation-in-part application of U.S. patent application Ser. No. 09/992,962, filed Nov. 6, 2001, entitled "A Chemically Processed Steel Sheet Excellent in Corrosion Resistance", now U.S. Pat. No. 6,730,414, which is hereby incorporated by reference in its entirety.

BACKGROUND OF THE INVENTION

1. Field of the Invention

The present invention relates to a chemically processed steel sheet having a converted layer, which is excellent in workability and corrosion resistance at both a flat plane and a worked or machined part, generated on a surface of an Al—Si alloy plating layer.

2. Description of Related Art

Al-coated steel sheets have been used as steel material excellent in corrosion resistance. But, when the Al-coated steel sheet is held as such in a humid atmosphere, exhaust gas or an environment subjected to dispersion of sea salt grains for a long time, its external appearance is worsened due to generation of white rust on the Al plating layer. Chromating effectively inhibits generation of white rust on a surface of the Al-coated steel sheet for the following reasons.

A chromate layer generated on a surface of a steel base is composed of complex oxides and hydroxides of trivalent and hexavalent Cr. Scarcely-soluble compounds of Cr(III), such as $Cr_2O_3$, act as a barrier against a corrosive atmosphere and protect a steel base from corroding reaction. Compounds of Cr(VI) are dissolved as oxoatic anions such as $Cr_2O_7^{2-}$ from the converted layer and re-precipitated as scarcely-soluble compounds of Cr(III) due to reducing reaction with exposed parts of a steel base formed by working or machining. Re-precipitation of Cr(III) compounds autogenously repairs defective parts of the converted layer, so that a corrosion-preventing effect of the converted layer is still maintained after working or machining.

Although chromating is effective for corrosion prevention of a steel sheet, it obliges a big load on post-treatment of Cr ion-containing waste fluid. In this regard, chemical liquors containing compounds such as titanium compounds, zirconium compounds or phosphates have been developed for generation of converted layers (hereinafter referred to as "Cr-free layers"), which do not contain chromium compounds or Cr ion, and some are already applied to aluminum DI (drawn and ironed) cans. For instance, JP 9-20984 A1 proposed an aqueous solution containing titanium compound, sulfuric phosphate, fluorides and an accelerator for coating an Al-containing metal part with a chemically converted (titanium compound) layer.

Titanium compound, zirconium compound or phosphate-containing converted layers, which have been proposed instead of the conventional chromate layer, do not exhibit such a self-repairing faculty as the chromate layer. For instance, a titanium compound layer does not exhibit a self-repairing faculty due to insolubility, although it is uniformly generated on a surface of a steel base in the same way as the chromate layer. As a result, the titanium compound layer is ineffective for suppression of corrosion starting at defective parts formed during chemical conversion or plastic deformation of a steel sheet. The other Cr-free layers are also insufficient for corrosion prevention due to poor self-repairing faculty.

When a small amount of a Cr-free chemical liquor is spread on an Al-coated steel sheet by a conventional method using an applicator roll or a spray wringer, an Al plating layer is not uniformly coated with a converted layer. The uncoated parts, i.e., surface parts where the Al plating layer is exposed to an atmosphere, act as starting points for corrosion or scratching during working, resulting in occurrence of damages in the converted layer or the Al plating layer. When a relatively thick converted layer is generated so as to completely cover the plating layer by spreading an excessive amount of a Cr-free chemical liquor, it does not work. On the contrary, defects such as cracks easily occur in the converted layer during press-working, since the converted layer cannot follow to deformation of a steel base. The defects, in addition to an insufficient self-repairing faculty, cause degradation of corrosion resistance.

SUMMARY OF THE INVENTION

The present invention is directed to a provision of a chemically processed steel sheet remarkably improved in corrosion resistance by generating a converted layer which contains both soluble and scarcely-soluble metal compounds, with a self-repairing faculty on an Al—Si alloy plating layer formed on a steel base.

The present invention proposes a new chemically processed steel sheet having a steel base coated with an Al—Si alloy plating layer containing 5–13 mass % Si. A surface of the plating layer is preferably reformed to a rugged state by concentration of Si so as to distribute Si-rich particles as convex parts thereon. Such distribution of Si-rich particles has an attained concentration of Si to 7–80 mass % at the surface of the plating layer.

A converted layer, which is generated on the rugged surface, contains a complex compound of Ti and Mn. The complex compound may be one or more of oxides, hydroxides, fluorides and organic acid salts. The converted layer may further contain one or more of phosphates, complex phosphates and lubricants. Concentration of Si at a surface of the plating layer is preferably controlled under the condition such that Si content within a range from the surface to at least 100 nm depth is adjusted to 7–80 mass %.

Another converted layer, which contains one or more oxides or hydroxides of valve metals together with fluorides, is also effective for corrosion prevention. The valve metal has the feature that its oxide exhibits high insulation resistance. The valve metal is selected from Ti, Zr, Hf, V, Nb, Ta, Mo and W. The self-repairing faculty of the converted layer is typically noted by the addition of one or more fluorides to the converted layer at an F/O atomic ratio not less than 1/100. The converted layer optionally contains organic or inorganic lubricants.

The converted layer may further contain one or more of soluble or scarcely-soluble metal phosphates or complex phosphates. The soluble metal phosphate or complex phosphate may be a salt of alkali metal, alkaline earth metal or Mn. The scarcely-soluble metal phosphate or complex phosphate may be a salt of Al, Ti, Zr, Hf or Zn.

A specific example is where the converted layer may contain at least one scarcely water soluble titanium-manganese complex compound and at least one water soluble manganese compound, generated on a surface of said plating layer, where the scarcely water soluble titanium-manganese complex compound is an oxide, hydroxide, phosphate, fluoride or an organic salt and the water soluble manganese compound is an oxide, hydroxide, fluoride or phosphate. As used herein, a scarcely water soluble manganese compound has a solubility in water at 15–25° C. of about 10 mg/l or less with a water soluble manganese compound having a solubility in water at 15–25° C. of over about 10 mg/l.

Another example is where the converted layer contains at least one scarcely water soluble compound, at least one water soluble compound and one or more of water soluble or scarcely water soluble metal phosphates and complex phosphates, generated on a surface of said plating layer, wherein the scarcely water soluble compound is an oxide or hydroxide of a valve metal and the water soluble compound is a fluoride of a valve metal.

One embodiment of the invention consists of a chemically processed steel sheet that has a steel base coated with an Al—Si alloy plating layer, and a converted layer, which contains at least one scarcely water soluble titanium manganese-complex compound and at least one water soluble manganese compound, generated on a surface of the plating layer. In a further embodiment, the Al—Si alloy plating layer has a Si content of approximately 5–13 mass % Si as a whole and approximately 7–80 mass % at its surface. In an even further embodiment, the Al—Si alloy plating layer has a rugged surface that Si-rich particles are distributed as convex particles thereon. The converted layer may or may not contain a lubricant.

DETAILED DESCRIPTION OF THE INVENTION

Manganese compounds and valve metal fluorides are effective components other than chromium compound, which give a self-repairing faculty to a converted layer, since these compounds are dissolved in water and then re-precipitated as scarcely-soluble compounds at defective parts of the converted layer.

The manganese compound in the converted layer is partially changed to a soluble component with a self-repairing faculty. Taking into account the self-repairing faculty of the manganese compound, the inventors experimentally added various kinds of chemical agents to a liquor for generation of a converted layer containing the manganese compound, and researched effects of the chemical agents on corrosion resistance of the converted layer. In the course of the research, the inventors discovered that addition of a titanium compound to the chemical liquor is effective for suppressing dissolution of the converted layer and for bestowing the converted layer with a self-repairing faculty, as disclosed in JP Application No. 2000-137136.

The titanium compound improves stability and corrosion resistance of a converted layer containing a manganese compound. On the basis of such effect of the titanium compound, the inventors have further researched for a method which can inhibit exposure of an Al plating layer through a converted layer generated even at a relatively small ratio, and discovered that a substrate suitable for improvement of corrosion resistance is an Al—Si alloy-coated steel sheet with concentration of Si at a surface of a plating layer. It is assumed that increase of Si content in a surface improves corrosion resistance of the converted layer for the following reason.

When an Al—Si alloy-coated steel sheet having Si concentrated at its surface is held in contact with a chemical liquor, Al is selectively etched away from the surface of the Al—Si plating layer, so that the surface of the plating layer is reformed to a rugged state having convex parts composed of metallic Si and concave parts enriched with Al. Since the chemical liquor is easily gathered in the concave parts, the concave parts are preferentially coated with complex compounds of Ti and Mn. The Si-rich convex parts and the Al-rich concave parts may be formed by acid-pickling, alkali-degreasing or the like prior to the chemical converting.

When the converted layer is generated in this way, the surface of the Al—Si plating layer is reformed to a hard rugged state due to the presence of metallic Si and a complex compound of Ti and Mn. The rugged surface favorably reduces an area (in other words, friction resistance) of the plating layer held in contact with a metal die during press-working. Such the state that Al-rich parts are scarcely exposed on the surface of the plating layer is also effective for anti-scratching property and reduction of Al picked up to an electrode during resistance welding, resulting in a long life time of the electrode. Furthermore, when a paint is applied to the converted plating layer, adhesiveness of a paint film is improved due to an anchoring effect of the rugged surface. Even if defects such as cracks occur in the converted layer, which cannot follow to plastic deformation of a steel base during press-working or machining, the defects are eliminated by the self-repairing faculty of the manganese compound. Consequently, good corrosion resistance is still maintained even at the worked or machined part.

The self-repairing faculty is also realized by the presence of a valve metal fluoride in a converted layer. In this case, a valve metal oxide or hydroxide is incorporated together with the fluoride in the converted layer. The valve metal is an element whose oxide exhibits high insulation resistance, such as Ti, Zr, Hf, V, Nb, Ta, Mo and W. The converted layer acts as a resistance against transfer of electrons due to inclusion of the valve metal oxide(s) or hydroxide(s) and suppresses reducing reaction caused by oxygen dissolved in water (oxidizing reaction of a steel base, in turn). Consequently, dissolution (corrosion) of metal components from a steel base is inhibited. Especially, tetravalent compounds of Group-IV A metals such as Ti, Zr and Hf are stable components for generation of converted layers excellent in corrosion resistance.

The oxide or hydroxide of the valve metal is effective as a resistance against transfer of electrons, when a converted layer is uniformly generated on a surface of a steel base. However, occurrence of defective parts in a converted layer is practically unavoidable during chemical conversion, press-working or machining. At the defective parts where the steel base is exposed to an atmosphere, the converted layer does not sufficiently inhibit corroding reaction. A soluble valve metal fluoride incorporated in the converted layer effectively realizes a self-repairing faculty for corrosion prevention at the defective parts. The valve metal fluoride is dissolved to water in an atmosphere and then re-precipitated as a scarcely-soluble oxide or hydroxide on a surface part of the steel base exposed through defective parts of the converted layer. Re-precipitation of the valve metal oxide or hydroxide repairs the defective parts, and the faculty of the converted layer for corrosion prevention is recovered.

For instance, a titanium compound layer generated on a surface of a steel base is composed of $TiO_2$ and $Ti(OH)_2$. When the titanium compound layer is microscopically observed, defects such as pinholes and very thin parts are detected in the titanium compound layer. The defects act as starting points for corroding reaction, since the steel base is exposed to an atmosphere through the defects. Although a conventional chromate layer exhibits a self-repairing faculty due to re-precipitation of a scarcely-soluble Cr(III) compound at defective parts, such that the self-repairing faculty is not expected as for the titanium compound layer. Defective parts of the converted layer are reduced by thickening the converted layer, but the hard titanium compound layer poor of ductility does not follow to plastic deformation of a steel base during working of the chemically processed steel sheet. As a result, defects such as cracks and biting easily occur in the converted layer during working or machining.

On the other hand, co-presence of a fluoride such as $X_nTiF_6$ (X is an alkali metal, an alkaline earth metal or $NH_4$, and n is 1 or 2) or $TiF_4$ in the converted layer promotes dissolution of a fluoride to water in an atmosphere and re-precipitation of a scarcely-soluble oxide or hydroxide according to the formula of $TiF_6^{2-}+4H_2O \rightarrow Ti(OH)_4+6F^-$. The re-precipitation means realization of a self-repairing faculty. A metal part of the fluoride may be either the same as or different from a metal part of the oxide or hydroxide. Some oxoates of Mo or W, useful as a valve metal, exhibit the self-repairing faculty due to solubility, so as to relax restrictions on a kind of fluoride to be incorporated in a converted layer.

The above-mentioned control of Si content in an Al—Si alloy plating layer also effectively inhibits exposure of Al in case of the titanium compound layer for the same reasons. The converted layer is uniformly generated on a rugged surface of the Al—Si alloy plating layer, and exposure of Al-rich parts is inhibited by controlling Si content of the plating layer. Defects such as cracks would occur in the converted layer during press-working, since the converted layer does not follow to plastic deformation of a steel base. Such defects are eliminated by the self-repairing faculty of the converted layer, so that the steel sheet still maintains sufficient corrosion resistance even at the deformed part.

A steel base may be low-C, medium-C, high-C or alloyed steel. Especially, low-C, Ti- or Nb-alloyed steel is suitable as a steel base which will be deeply drawn to an objective shape at a heavy working ratio.

The steel base is coated with an Al plating layer by a conventional hot-dip process. The plating layer preferably contains 5–13 mass % Si. Si content not less than 5 mass % favorably accelerates concentration of Si at a surface of the plating layer and also inhibits growth of an alloyed layer, which puts harmful influences on workability, at boundaries between the steel base and the plating layer. However, excessive Si content more than 13 mass % promotes precipitation of primary Si in the plating layer during cooling succession to hot-dipping and significantly degrades workability of the coated steel sheet.

After a steel sheet coated with an Al—Si alloy plating layer, whose Si content is controlled in a range of 5–13 mass % is raised from a hot-dip bath, it is cooled at a controlled cooling speed so as to concentrate Si at a surface of the plating layer. Thereafter, the coated steel sheet is pickled with an acid or degreased with an alkali, so that its surface is reformed to a rugged state comprising Si-rich convex parts and Al-rich concave parts. In this case, the coated steel sheet is washed with water and then dried. The rugged surface may be formed by treating the hot-dip coated steel sheet with a chemical liquor, which has etching activity on Al, instead of acid-pickling or alkali-degreasing. In this case, Al is selectively etched off a surface of the plating layer at a time when the steel sheet is dried to generate a converted layer thereon after application of the chemical liquor. Due to selective removal of Al from the plating layer, the surface of the plating layer is reformed to a rugged state.

The situation that Si-rich convex parts and Al-rich concave parts are distributed on a surface of a plating layer is confirmed by AES analysis for scanning and analyzing an area of 1 mm×1 mm and an Ar sputtering method for repeatedly analyzing the plating layer in a region from the surface to 100 nm depth. Results of experiments prove that concentration of Si not less than 7 mass % in the region from the surface to 100 nm depth effectively improves corrosion resistance at both a flat plane and a worked or machined part. However, if Al is excessively etched off the plating layer until Si content exceeds 80 mass %, the surface of the plating layer becomes so fragile that a converted layer generated thereon would be easily peeled off without following to deformation of a steel sheet during press-working.

A complex compound layer containing one or more of manganese compounds for realization of a self-repairing faculty is generated by applying an aqueous solution containing titanium and manganese compounds to a hot-dip coated steel sheet, and then drying the steel sheet as such. The titanium compound may be one or more of $K_2TiF_6$, $TiOSO_4$, $(NH_4)_2TiF_6$, $K_2[TiO(COO)_2]$, $TiCl_4$, $Ti(SO_4)_2$ and $Ti(OH)_4$. The manganese compound may be one or more of $Mn(H_2PO_4)_2$, $MnCO_3$, $Mn(NO_3)_2$, $Mn(OH)_2$, $MnSO_4$, $MnCl_2$ and $Mn(C_2H_3O_2)_2$.

The chemical liquor preferably contains a manganese compound at a ratio of 0.1–100 g/l calculated as Mn. Concentration of Mn not less than 0.1 g/l is necessary for deposition of manganese compound effective for improvement of corrosion resistance, but excessive concentration of Mn, more than 100 g/l, unfavorably degrades stability of the chemical converting liquor. A titanium compound is preferably added to the chemical liquor at such a ratio that a mole ratio of Ti/Mn is controlled in a range of 0.05–2. A Ti/Mn mole ratio not less than 0.05 assures improvement of corrosion resistance without degrading a self-repairing faculty of the converted layer. An effect of the titanium compound on improvement of corrosion resistance is noted at a Ti/Mn mole ratio more than 2, but an excessive Ti/Mn mole ratio causes instability of the chemical liquor and raises a processing cost.

An organic acid with chelating faculty may be further added to the chemical liquor in order to maintain scarcely-soluble metals (e.g., Ti and Mn) as stable metal ions in the chemical liquor. Such organic acid may be one or more of tartaric, tannic, citric, malonic, lactic and acetic acids. The organic acid is preferably added to the chemical liquor at an organic acid/Mn mole ratio of 0.05–1. An effect of the organic acid on the stability of the chemical liquor is noted at an organic acid/Mn mole ratio not less than 0.05, but an organic acid/Mn mole ratio more than 1 causes falling of a pH value of the chemical liquor and degradation of continuous processability.

The chemical liquor is adjusted at a pH value in a range of 1–6 by quantitatively controlled addition of a titanium compound, a manganese compound, phosphoric acid or a phosphate, a fluoride and an organic acid at proper ratios. A pH value below 1 accelerates dissolution of Al and worsens continuous processability, but a pH value above 6 causes precipitation of titanium compounds and instability of the chemical liquor.

A converted layer containing valve metal fluoride(s) for realization of a self-repairing faculty is generated by spreading either a coat-type or reaction-type chemical liquor to an Al—Si alloy-coated steel sheet. The reaction-type chemical liquor is preferably adjusted to a relatively low pH value to assure its stability. In the following explanation, Ti is used as a valve metal. The other valve metals are also used in the same way.

A chemical liquor contains a soluble halide or oxoate as a Ti source. Titanium fluoride is useful as both Ti and F sources, but a soluble fluoride such as $(NH_4)F$ may be supplementarily added to the chemical liquor. In concrete, the Ti source may be $X_nTiF_6$ (X is an alkali or alkaline earth metal, n is 1 or 2), $K_2[TiO(COO)_2]$, $(NH_4)_2TiF_6$, $TiCl_4$, $TiOSO_4$, $Ti(SO_4)_2$ or $Ti(OH)_4$. Ratios of these fluorides are determined such that a converted layer having a predetermined composition of oxide(s) or hydroxide(s) and fluoride(s) is generated by drying and baking a steel sheet onto which the chemical liquor has been spread.

An organic acid with chelating faculty may be further added to the chemical liquor in order to maintain a Ti source as a stable ion in the chemical liquor. The organic acid may be one or more of tartaric, tannic, citric, oxalic, malonic, lactic and acetic acids. Especially, oxycarboxylic acids such as tartaric acid and polyhydric phenols such as tannic are advantageous in stability of the chemical liquor, adding to the self-repairing faculty of a fluoride and the adhesiveness of a paint film. The organic acid is preferably added to the chemical liquor at an organic acid/Mn mole ratio not less than 0.02.

An F/O atomic ratio of a converted layer is preferably adjusted to a value not less than 1/100 in order to realize a self-repairing faculty of a fluoride in the converted layer. F and O atoms in the converted layer are analyzed by X-ray fluorescence, ESCA, or the like. The self-repairing faculty derived from hydrolysis of a fluoride is insufficient at an F/O atomic ratio less than 1/100, so that defective parts of the converted layer or cracks formed in the converted layer during press-working sometimes act as starting points for propagation of corrosion.

Orthophosphates or polyphosphates of various metals may be added for incorporation of soluble or scarcely-soluble metal phosphates or complex phosphates in a converted layer.

A soluble metal phosphate or complex phosphate is dissolved from a converted layer, reacted with Al in a plating layer through defective parts of the converted layer, and re-precipitated as a scarcely-soluble phosphate which assists a self-repairing faculty of manganese oxide or hydroxide or titanium fluoride. An atmosphere is slightly acidified on dissociation of the soluble phosphate, so as to accelerate hydrolysis of manganese oxide or hydroxide or titanium fluoride, in other words, generation of scarcely-soluble compounds.

A metal component capable of generating a soluble phosphate or complex phosphate is an alkali metal, an alkaline earth metal, Mn and so on. These metals are added as metal phosphates alone or together with phosphoric acid, polyphosphoric acid or phosphate to the chemical liquor.

A converted layer containing manganese compound(s) for realization of a self-repairing faculty is further improved in corrosion resistance by the addition of phosphoric acid or phosphate as a component for generation of a scarcely-soluble phosphate to a chemical liquor. The phosphate may be manganese phosphate, sodium dihydrogenphosphate, disodium hydrogenphosphate, magnesium phosphate and dihydrogenammonium phosphate. The phosphoric acid or phosphate is preferably added to the chemical liquor at a P/Mn mole ratio not less than 0.2 for improvement of corrosion resistance. However, a P/Mn mole ratio more than 4 causes instability of the chemical liquor.

A scarcely-soluble metal phosphate or complex phosphate may be dispersed in a converted layer containing a fluoride for realization of a self-repairing faculty, so as to eliminate occurrence of defects and to improve strength of the converted layer. A metal component capable of generating a scarcely-soluble phosphate or complex phosphate is Al, Ti, Zr, Hf, Zn and so on. These metals are added as metal phosphates alone or together with phosphoric acid, polyphosphoric acid or phosphate to the chemical liquor.

Such a fluoride as KF, NaF or $NH_4F$, which is easily dissociated to fluoride ion as an etching element to Al, may be added to the chemical liquor. These fluorides may be added alone or together with a fluoride with small dissociation constant such as silicofluoride or with titanium or manganese fluoride. The fluoride is preferably added to the chemical liquor at an F/Mn mole ratio not more than 10.

The prepared chemical liquor is spread to an Al—Si alloy-coated steel sheet by an applicator roll, a spinner, a sprayer or the like, and then the steel sheet is dried as such without washing. Consequently, a converted layer of good corrosion resistance is generated on a surface of the plating layer. The chemical liquor is preferably applied to the plating layer at a ratio not less than 1 $mg/m^2$ calculated as deposited Mn or Ti for realization of excellent corrosion resistance. A quantitative effect of the chemical liquor on corrosion resistance is saturated at a ratio of 1000 $mg/m^2$ calculated as deposited Mn or Ti, and further improvement of corrosion resistance is not expected even if the chemical liquor is applied at a ratio more than 1000 $mg/m^2$ for generation of a thicker converted layer.

The steel sheet, which has a converted layer generated from the chemical liquor applied to a surface of a plating layer, may be dried at an ordinary temperature, but preferably dried within a short time at a temperature of 50° C. or higher allowing continuous processability. However, drying at too high a temperature above 200° C. causes thermal decomposition of organisms in the case of generating a converted layer containing organisms, resulting in degradation of corrosion resistance.

The converted layer can be bestowed with lubricity by addition of a lubricant to a chemical liquor, in order to suppress occurrence of damages in the converted layer as well as the plating layer during press-working or machining. The lubricant may be one or more of powdery synthetic resins, for instance polyolefin resin such as fluorocarbon polymer, polyethylene, and polypropylene, styrene resin such as ABS and polystyrene or halide resin such as vinyl chloride and vinylidene chloride. Inorganic powder such as silica, molybdenum disulfide, graphite or tungsten disulfide is also used as a lubricant. An effect of the lubricant on workability of a chemically processed steel sheet is noted at a ratio of the lubricant to the converted layer being not less than 1 mass %. Excessive addition of the lubricant at a ratio more than 25 mass % impedes generation of the converted layer and worsens corrosion resistance.

An organic paint film of good corrosion resistance may be applied on the converted layer. The paint film is formed by applying a resin paint containing one or more of olefinic resins such as urethane, epoxy, polyethylene, polypropylene and ethylene-acrylic copolymer, styrenic resins such as polystyrene, polyesters, acrylic resins or these copolymers or degenerated resins. The resin paint may be applied to the converted layer by an applicator roll or electrostatic atomization. When a paint film of 0.5–5 μm in thickness is applied on the converted layer, the converted layer surpasses a conventional chromate layer in corrosion resistance.

Lubricity during press-working is ensured by addition of an organic or inorganic lubricant to the paint film. Resistance weldability is improved by the addition of inorganic sol. The paint film may be either alkali-soluble or insoluble. Alkali solubility of the paint film is controlled by a ratio of acrylic acid incorporated in the resin. The paint film becomes alkali-soluble as the acrylic acid is increased, and insoluble as the acrylic acid is decreased.

EXAMPLE

A cold-rolled low-C Ti-alloyed steel sheet of 0.8 mm in thickness was coated with an Al—Si alloy (containing 6–11 mass % Si) plating layer at an adhesion ratio of 35 g/m$^2$ (calculated to 13 μm in averaged thickness) by a continuous hot-dip coating line. The coated steel sheet was used as a base sheet on which various converted layers were generated as follows:

Converted Layers Comprising Complex Compounds of Ti and Mn

Several chemical liquors having compositions shown in Table 1 were prepared by mixing titanium compounds, manganese compounds, fluorides, phosphoric acid or phosphates and organic acids at various ratios.

In a corrosion test for evaluation of corrosion resistance at a flat plane, an edge of each test piece was sealed, and a 5%-NaCl solution was sprayed onto a flat plane of the test piece under the conditions regulated in JIS Z2371. After the salt water spraying was continued for a predetermined time, the flat plane of the test piece was observed to detect occurrence of white rust. A surface area rate of the test piece occupied by white rust was calculated. Corrosion resistance of the chemically processed steel sheet was evaluated in response to calculation results of the area rates as follows: an area rate not more than 5% as ⊙, an area rate of 5–10% as O, an area rate of 10–30% as Δ, an area rate of 30–50% as ▲ and an area rate more than 50% as X.

In a corrosion test for evaluation of corrosion resistance at a worked part, each test piece of 35 mm×200 mm in size was tested by bead-drawing examination under conditions of bead height of 4 mm, radius of 4 mm at a top of a bead and a pressure of 4.9 kN, and then the same salt water as above-mentioned was sprayed to the worked test piece for a predetermined time. Thereafter, the worked part of the test piece was observed, and corrosion resistance at the worked part was evaluated under the same standards as for corrosion resistance at the flat plane.

TABLE 1

COMPOSITIONS OF CHEMICAL LIQUORS

| Liquor | a Mn source | | a Ti source | | a P source | | an organic acid | | a F source | | |
|---|---|---|---|---|---|---|---|---|---|---|---|
| No. | kind | (1) | kind | (2) | kind | (3) | kind | (4) | kind | (5) | NOTE |
| 1 | $Mn(H_2PO_4)_2$ | 15 | $(NH_4)_2TiF_6$ | 1 | (manganese compound) | 2 | tartaric acid | 0.3 | (titanium compound) | 6 | Inventive Examples |
| 2 | $Mn(H_2PO_4)_2$ | 60 | $(NH_4)_2TiF_6$ | 0.1 | $H_3PO_4$ | 3 | tartaric and tannic acids | 0.8 | (titanium compound) | 0.6 | |
| 3 | $Mn(H_2PO_4)_2$ | 1 | $K_2TiF_6$ | 2 | (manganese compound) | 2 | tannic acid | 1 | $(NH_4)F$ | 5 | |
| 4 | $Mn(H_2PO_4)_2$ | 15 | $K_2(TiO(COO)_2)$ | 0.2 | $H_3PO_4$ | 4 | (titanium compound) | 0.4 | $(NH_4)F$ | 8 | |
| 5 | $MnCO_3$ | 10 | $(NH_4)_2TiF_6$ | 0.8 | $H_3PO_4$ | 0.2 | citric acid | 1 | (titanium compound) | 4.8 | |
| 6 | $Mn(NO_3)_2$ | 100 | $TiOSO_4$ | 0.5 | $H_3PO_4$ | 1 | citric and malonic acids | 0.5 | $(NH_4)F$ | 3 | |
| 7 | — | — | $(NH_4)_2TiF_6$ | 1 | (manganese compound) | 2 | tartaric acid | 0.3 | (titanium compound) | 6 | Comparative Examples |
| 8 | $Mn(H_2PO_4)_2$ | 30 | — | — | (manganese compound) | 2 | tartaric acid | 0.5 | (titanium compound) | 0.06 | |

(1) concentration (g/l) of Mn,
(2) a Ti/Mn mole ratio
(3) a P/Mn mole ratio
(4) an organic acid/Mn mole ratio
(5) a F/Mn mole ratio After each of the chemical liquors was spread to the Al—Si alloy-coated steel sheet, the steel sheet was carried into an oven as such without washing and then dried at a temperature up to 120° C. A converted layer generated in this way was examined by X-ray fluorescence, AES and ESCA analyses to measure concentration of Si in a region from a surface to 100 nm depth of the plating layer and concentration of Mn in the converted layer, and also to calculate mole ratios of Ti/Mn, P/Mn, F/Mn and organic acid/Mn.

A test piece was cut off each processed Al—Si alloy-coated steel sheet and subjected to a corrosion test and a resistance-welding test.

In a resistance-welding test, two test pieces were overlapped together and spot-welded with an electrode made of a Cr—Cu alloy. A proper electric current and a proper load were previously determined for each test piece, and a welding current was raised at a constant ratio every predetermined number of spots. Resistance weldability of each chemically processed steel sheet was evaluated in response to a number of welded spots as follows: 00–1000 spots as O and less than 500 spots as X.

Test results are shown in Table 2. It is understood that each of Sample Nos. 1–6, which had converted layers generated according to the present invention, was having good resistance weldability and corrosion resistance at both a flat plane and a worked part.

On the other hand, Sample No. 7 having a converted layer, which did not contain Mn, was poor in corrosion resistance at a worked part due to insufficient self-repairing faculty. Sample No. 8 having a converted layer, which did not contain a titanium compound, was poor in corrosion resistance at both a flat plane and a worked part due to insufficient shielding faculty. Sample No 9, which had a converted layer generated on an Al plating layer free from Si, was inferior in quality due to exposure of Al-rich parts, although the same chemical liquor was used.

After each chemical liquor shown in Table 3 was spread to the Al—Si alloy-coated steel sheet by an applicator roll, the steel sheet was carried to an oven without washing and then dried as such at a temperature up to 120° C. A converted layer generated in this way was examined by X-ray fluorescence, AES and ESCA analyses to measure concentration of Si in a region from a surface to 100 nm depth of the plating layer and concentration of each component in the converted layer. Results are shown in Table 4.

TABLE 2

COMPOSITIONS AND QUALITY OF CONVERTED LAYERS

| Liquor No. | deposition rate of Mn ($mg/m^2$) | mole ratios of components in converted layers: Ti/Mn | P/Mn | F/Mn | organic acid/Mn | Si content of plating layers (mass %): as a whole | at a surface | corrosion-resistance: at a flat plane | at a worked part | resistance-weldability | NOTE |
|---|---|---|---|---|---|---|---|---|---|---|---|
| 1 | 5 | 1 | 2 | 6 | 0.2 | 9.5 | 50 | ○ | ○ | ○ | Inventive Examples |
| 2 | 100 | 0.1 | 3 | 0.6 | 0.8 | 8.5 | 20 | ⊙ | ○ | ○ | |
| 3 | 10 | 2 | 2 | 10 | 0.7 | 6 | 7 | ⊙ | ○ | ○ | |
| 4 | 80 | 0.2 | 4 | 8 | 0.4 | 10 | 60 | ⊙ | ○ | ○ | |
| 5 | 60 | 0.8 | 0.2 | 4.8 | 1 | 9 | 40 | ⊙ | ○ | ○ | |
| 6 | 200 | 0.5 | 1 | 3 | 0.5 | 11 | 80 | ⊙ | ○ | ○ | |
| 7 | — | Ti: 50, P: 65, F: 1 and organic acid: 72 ($mg/m^2$) | | | | 9.5 | 50 | ⊙ | ▲ | ○ | Comparative Examples |
| 8 | 60 | — | 2 | 0.06 | 0.5 | 9.5 | 50 | X | X | ○ | |
| 1 | generation of a converted layer on an Al alloy plating layer free from Si, using Liquor No. 1 | | | | | 0 | 0 | X | X | X | |

Converted Layers Comprising Complex Compounds of Ti and F

Several chemical liquors having compositions shown in Table 3 were prepared by the addition of Ti and F sources optionally together with various metal compounds, organic acids and phosphates.

TABLE 3

CHEMICAL LIQUORS USED IN EXAMPLE 1

| Liquor No. | a Ti source: kind | (1) | a F source: kind | (2) | a phosphate source: kind | (3) | an organic acid: kind | (4) | other metal salts: kind | (5) | NOTE |
|---|---|---|---|---|---|---|---|---|---|---|---|
| 1 | $(NH_4)_2TiF_6$ | 20 | (titanium compound) | 47.5 | $H_3PO_4$ | 40 | tannic acid | 4 | — | — | Inventive Examples |
| 2 | $(NH_4)_2TiF_6$ | 12 | (titanium compound) | 28.5 | $Mn(H_2PO_4)_2$ | 16.9 | tartaric acid | 15 | Mn(phosphate) | Mn: 15 | |
| 3 | $K_2TiF_6$ | 10 | (titanium compound) | 23.8 | $(NH_4)H_2PO_4$ | 5 | citric acid | 2 | $(NH_4)_6Mo_7O_{23}$ | Mo: 3 | |
| 4 | $K_2[TiO(COO)_2]$ | 15 | $(NH_4)$ F | 15 | $MgHPO_4$ | 24 | (titanium compound) | 27.6 | Mg(phosphate) | Mg: 19 | |
| 5 | $(NH_4)_2TiF_6$ | 30 | (titanium compound) | 71.3 | $H_3PO_4$ | 50 | tannic acid | 5 | — | — | |
| 6 | $TiOSO_4$ | 50 | $(NH_4)$ F | 5 | $(NH_4)H_2PO_4$ | 20 | tartaric acid | 10 | — | — | |
| 7 | $TiOSO_4$ | 20 | — | — | $H_3PO_4$ | 5 | — | — | — | — | Comparative |
| 8 | — | — | $(NH_4)$ F | 10 | $H_3PO_4$ | 20 | tannic acid | 2 | — | — | Examples |

(1) concentration (g/l) of Ti
(2) concentration (g/l) of F
(3) concentration (g/l) of P
(4) concentration (g/l) of an organic acid
(5) concentration (g/l) of a metal

TABLE 4

CONCENTRATION OF SILICON AT A SURFACE OF A PLATING LAYER AND COMPOSITION OF A CONVERTED LAYER

| Liquor | Si content (mass %) of a plating layer | | deposition rate | concentration (atomic %) of atoms in a converted layer | | | | | |
|---|---|---|---|---|---|---|---|---|---|
| No. | as a whole | at a surface | ($mg/m^2$) of Ti | Ti | O | F | P | other metals | NOTE |
| 1 | 9.5 | 50 | 35 | 4 | 70 | 14 | 12 | — | Inventive Examples |
| 2 | 10 | 60 | 45 | 4 | 68 | 14 | 9 | Mn: 5 | |
| 3 | 11 | 80 | 15 | 7 | 54 | 33 | 5 | Mo: 1 | |
| 4 | 9 | 40 | 20 | 3 | 78 | 3 | 8 | Mg: 8 | |
| 5 | 8.5 | 20 | 50 | 5 | 64 | 19 | 12 | — | |
| 6 | 6 | 7 | 80 | 9 | 85 | 1 | 5 | — | |
| 7 | 7 | 15 | 40 | 23 | 68 | — | 9 | — | Comparative |
| 8 | 9.5 | 50 | (P: 30) | — | 70 | 12 | 18 | — | Examples |

A test piece was cut off each processed Al—Si alloy-coated steel sheet and subjected to the same tests as above-mentioned.

Test results are shown in Table 5. It is understood that any of Sample Nos. 1–6, which had converted layers generated according to the present invention, had good resistance weldability and corrosion resistance at both a flat plane and a worked part.

On the other hand, Sample No. 7 having a converted layer, which did not contain soluble titanium fluoride, had poor corrosion resistance at defective parts of the converted layer due to poor self-repairing faculty. Sample No. 8 having a converted layer, which did not contain a titanium compound, had poor corrosion resistance at both a flat plane and a worked part due to poor shielding faculty. Sample No 9, which had a converted layer generated on an Al plating layer free from Si, was of inferior quality due to exposure of Al-rich parts, although the same chemical liquor No. 1 was used.

TABLE 5

PROPERTIES OF CHEMICALLY PROCESSED STEEL SHEETS

| Sample No. | Liquor No. | Corrosion-resistance at a flat plane | at a worked part | resistance - weldability | NOTE |
|---|---|---|---|---|---|
| 1 | 1 | ◎ | ○ | ○ | Inventive |
| 2 | 2 | ◎ | ◎ | ○ | Examples |

TABLE 5-continued

PROPERTIES OF CHEMICALLY PROCESSED STEEL SHEETS

| Sample No. | Liquor No. | Corrosion-resistance at a flat plane | at a worked part | resistance - weldability | NOTE |
|---|---|---|---|---|---|
| 3 | 3 | ◎ | ◎ | ○ | |
| 4 | 4 | ◎ | ◎ | ○ | |
| 5 | 5 | ◎ | ○ | ○ | |
| 6 | 6 | ◎ | ○ | ○ | |
| 7 | 7 | ◎ | Δ | ○ | Comparative |
| 8 | 8 | X | X | ○ | Examples |
| 9 | 1 | X | X | X | |

Sample No. 9: a Si-free Al-coated steel sheet processed with Chemical Liquor No. 1

Converted Layers Comprising Complex Compounds of Other Valve Metals and F

Several chemical liquors having compositions shown in Table 6 were prepared by mixing valve metal sources other than Ti with F sources, and optionally adding various metal compounds, organic acids and phosphoric acid.

After each chemical liquor was spread to an Al—Si alloy-coated steel sheet by an applicator roll, the steel sheet was carried to an oven without washing and then dried as such at a temperature up to 160° C. to generate a converted layer thereon.

TABLE 6

COMPOSITIONS OF CHEMICAL LIQUORS USED IN EXAMPLE 2

| Liquor | a valve metal source | | a F source | | a phosphate source | | an organic acid | | other metal salts | |
|---|---|---|---|---|---|---|---|---|---|---|
| No. | kind | (1) | kind | (2) | kind | (3) | kind | (4) | kind | (5) |
| 1 | $(NH_4)_2ZrF_6$ | 10 | (zirconium compound) | 12.5 | $H_3PO_4$ | 6 | tartaric acid | 10 | — | — |
| 2 | $Zr(SO_4)_2$ | 8 | $(NH_4)F$ | 15 | $Mn(H_2PO_4)_2$ | 7.9 | tartaric acid | 5 | Mn (phosphate) | Mn: 7 |
| 3 | $Na_2WO_4$<br>$(NH_4)_2TiF_6$ | 20<br>1 | (titanium compound) | 2.4 | $H_3PO_4$ | 30 | oxalic acid | 8 | — | — |
| 4 | $TiOSO_4$<br>$VF_4$ | 20<br>10 | (vanadate) | 15 | $MgHPO_4$ | 12 | tannic acid | 5 | Mg (phosphate) | Mg: 9.3 |

TABLE 6-continued

COMPOSITIONS OF CHEMICAL LIQUORS USED IN EXAMPLE 2

| Liquor | a valve metal source | | a F source | | a phosphate source | | an organic acid | | other metal salts | |
|---|---|---|---|---|---|---|---|---|---|---|
| No. | kind | (1) | kind | (2) | kind | (3) | kind | (4) | kind | (5) |
| 5 | $K_2NbF_7$ | 16 | (niobium salt) | 22.6 | $H_3PO_4$ | 20 | oxalic acid | 15 | — | — |
| 6 | $K_2(MoO_2F_4)$ | 20 | (molybdate) | 15.8 | $(NH_4)H_2PO_4$ | 15 | tartaric acid | 10 | — | — |

(1) concentration (g/l) of a valve metal
(2) concentration (g/l) of F
(3) concentration (g/l) of P
(4) concentration (g/l) of an organic acid
(5) concentration (g/l) of a metal Each chemically processed steel sheet was examined to measure concentration of Si in a region from a surface to 100 nm depth and concentrations of components in a converted layer by the same way as above-mentioned. Results are shown in Table 7.

TABLE 7

SILICON CONTENT AT A SURFACE OF A PLATING LAYER AND COMPOSITION OF A CONVERTED LAYER

| Liquor No. | Si content (mass %) of a plating layer: as a whole | Si content (mass %) of a plating layer: at a surface | deposition rate ($mg/m^2$) of: a valve metal | composition (atomic %) of a converted layer: a valve metal | O | F | P | other metals |
|---|---|---|---|---|---|---|---|---|
| 1 | 11 | 80 | Zr: 30 | Zr: 5 | 65 | 22 | 8 | — |
| 2 | 8.5 | 20 | Zr: 50 | Zr: 2 | 74 | 13 | 7 | Mn: 4 |
| 3 | 9 | 40 | W: 37<br>Ti: 7 | W: 2<br>Ti: 0.5 | 80 | 1.5 | 16 | — |
| 4 | 9.5 | 50 | Ti: 44<br>V: 21 | Ti: 6<br>V: 3 | 70 | 9 | 6 | Mg: 6 |
| 5 | 6 | 7 | Nb: 40 | Nb: 3 | 64 | 21 | 12 | — |
| 6 | 10 | 60 | Mo: 70 | Mo: 5 | 71 | 13 | 11 | — |

A test piece was cut off each processed steel sheet and subjected to the same tests as above-mentioned.

Results are shown in Table 8. It is understood that any of Sample Nos. 1–6 is excellent in resistance weldability and corrosion resistance at both a flat plane and a worked part.

TABLE 8

PROPERTIES OF CHEMICALLY PROCESSED STEEL SHEETS

| Liquor No. | Corrosion resistance: at a flat plane | Corrosion resistance: at a worked part | resistance-weldability |
|---|---|---|---|
| 1 | ◎ | ○ | ○ |
| 2 | ◎ | ◎ | ○ |
| 3 | ◎ | ○ | ○ |
| 4 | ◎ | ◎ | ○ |
| 5 | ◎ | ○ | ○ |
| 6 | ◎ | ○ | ○ |

The steel sheet chemically processed according to the present invention comprises a steel base coated with an Al—Si alloy plating layer and a converted layer generated on a surface of the plating layer. The converted layer contains both soluble and scarcely-soluble compounds. The soluble compound is dissolved in water in an atmosphere and re-precipitated as a scarcely-soluble compound at defective parts of the converted layer by reaction with a steel base. The scarcely-soluble compound acts as a barrier for corrosion prevention of a steel base. Since the re-precipitation bestows the converted layer with a self-repairing faculty so as to inhibit exposure of the steel base through the defective parts, the steel sheet still maintains excellent corrosion resistance after press-working or machining.

The surface of the Al—Si plating layer can be reformed to a rugged state by concentration of Si at its surface, so that the steel sheet is plastically deformed to an objective shape with slight sliding resistance during press-working. Even if defects are introduced to the converted layer during deformation, such defects are eliminated by the self-repairing faculty of the manganese compound or fluoride. Consequently, good corrosion resistance is still maintained after the deformation. Moreover, the converted layer is free from Cr which would put harmful influences on the environment, so that the proposed steel sheet will be used in broad industrial fields instead of a conventional chromated steel sheet.

The invention claimed is:

1. A chemically processed steel sheet comprising:

a steel base coated with an Al—Si alloy plating layer; and a converted layer, which contains at least one scarcely water soluble titanium-manganese complex compound and at least one water soluble manganese compound, generated on a surface of said plating layer.

2. The chemically processed steel sheet defined in claim 1, wherein the Al—Si alloy plating layer has a Si content of approximately 5–13 mass % Si as a whole and approximately 7–80 mass % at its surface.

3. The chemically processed steel sheet defined in claim 1, wherein the converted layer further contains at least a lubricant.

4. A chemically processed steel sheet comprising:

a steel base coated with an Al—Si alloy plating layer, and a converted layer, which contains at least one scarcely water soluble titanium-manganese complex compound and at least one water soluble manganese compound, generated on a surface of said plating layer, wherein the Al—Si alloy plating layer has a Si content of approximately 5–13 mass % Si as a whole and approximately 7–80 mass % at its surface; and wherein the Al—Si alloy plating layer has a rugged surface that Si-rich particles are distributed as convex parts thereon.

5. A chemically processed steel sheet comprising:

a steel base coated with an Al—Si alloy plating layer, and a converted layer, which contains at least one scarcely water soluble titanium-manganese complex compound and at least one water soluble manganese compound, generated on a surface of said plating layer, wherein the at least one scarcely water soluble titanium-manganese complex compound is an oxide, hydroxide, phosphate, fluoride or an organic salt and the at least one water soluble manganese compound is an oxide, hydroxide, fluoride or phosphate.

6. A chemically processed steel sheet comprising:

a steel base coated with an Al—Si alloy plating layer, and a converted layer, which contains at least one scarcely water soluble compound, at least one water soluble compound and one or more of water soluble or scarcely water soluble metal phosphates and complex phosphates, generated on a surface of said plating layer, wherein the at least one scarcely water soluble compound is an oxide or hydroxide of a valve metal and the at least one water soluble compound is a fluoride of a valve metal.

* * * * *